US007380555B1

(12) United States Patent
Stricklen et al.

(10) Patent No.: US 7,380,555 B1
(45) Date of Patent: Jun. 3, 2008

(54) BRAID SEPARATION SYSTEM

(76) Inventors: Lillian Stricklen, 3333 N. 22nd St., Milwaukee, WI (US) 53260; Virginia Stricklen-Grady, 3331 N. 22nd St., Milwaukee, WI (US) 53206

( * ) Notice: Subject to any disclaimer, the term of this patent is extended or adjusted under 35 U.S.C. 154(b) by 0 days.

(21) Appl. No.: 11/261,079

(22) Filed: Oct. 28, 2005

(51) Int. Cl.
*A45D 24/22* (2006.01)

(52) U.S. Cl. ..... 132/114

(58) Field of Classification Search ..... 132/112, 132/113, 114, 115, 322; 433/80, 89; 601/162; 401/156, 183, 184, 185, 158, 159, 160, 161; 16/425, 426, 430
See application file for complete search history.

(56) References Cited

U.S. PATENT DOCUMENTS

| | | | | | |
|---|---|---|---|---|---|
| 678,004 | A | * | 7/1901 | Myers | 132/114 |
| 1,407,230 | A | * | 2/1922 | Spielberger | 132/114 |
| 1,881,447 | A | * | 10/1932 | Ford | 401/159 |
| 2,956,570 | A | | 10/1960 | Stanford | |
| 4,211,247 | A | * | 7/1980 | Morganroth | 132/270 |
| 4,354,512 | A | | 10/1982 | Roppatte, Jr. | |
| 4,602,651 | A | | 7/1986 | Roppatte, Jr. | |
| 4,813,439 | A | | 3/1989 | Morgan | |
| 4,934,388 | A | | 6/1990 | Gibbs | |
| 5,067,501 | A | * | 11/1991 | Auger | 132/112 |
| 5,289,833 | A | * | 3/1994 | McDonald | 132/112 |
| D353,019 | S | | 11/1994 | Kimmell et al. | |
| 5,499,637 | A | | 3/1996 | Foti | |
| 6,050,271 | A | * | 4/2000 | Spencer | 132/112 |
| 6,095,813 | A | * | 8/2000 | Broyles | 433/80 |
| 2002/0142263 | A1 | * | 10/2002 | Robinson | 433/89 |

* cited by examiner

*Primary Examiner*—Robyn Doan
*Assistant Examiner*—Rachel A. Running

(57) ABSTRACT

A braid separation system for facilitating separating the strands of hair of a braid to unravel the braid. The braid separation system includes a pick member for positioning between the strands of the braids and is pulled through the braid to separate the strands of the braids. A reservoir member for holding fluid to be applied to the hair by the pick member to help relax the strands of hair of the braid when the pick member is pulled through the braid. The reservoir member is removably coupled to the pick member. The reservoir member is configured to permit gripping of the reservoir member to facilitate maneuvering of the pick member by the hand of the user.

1 Claim, 3 Drawing Sheets

BRAID SEPARATION SYSTEM

BACKGROUND OF THE INVENTION

1. Field of the Invention

The present invention relates to hair picks and more particularly pertains to a new braid separation system for facilitating separating the strands of hair of a braid to unravel the braid without, for example, causing damage or breakage to the hair strands by applying detangling solution substantially directly into the braid while separating the braided hair.

2. Description of the Prior Art

The use of hair picks often requires a user to hold their wrist at an uncomfortable angle that generally extends away from the head. Further, many hair picks are straight and therefore require the hair pick to be held at an approximately 90 degree angle to the hair which can produce an uncomfortable position for the wrist of the user. Additionally, many hair picks are narrow and irregularly shaped, which can make the control of the hair pick difficult.

SUMMARY OF THE INVENTION

In view of the foregoing disadvantages inherent in the known types of hair picks now present in the prior art, the present invention provides a new braid separation system construction wherein the same can be utilized for facilitating separating the strands of hair of a braid to unravel the braid.

To attain this, the present invention generally comprises a pick member for positioning between the strands of the braids and is pulled through the braid to separate the strands of the braids. A reservoir member is provided for holding a fluid (such as detangling solution or a conditioner that is intended to be left in the hair) to be applied to the both the braid and the base of the braid of hair by the pick member to help relax the strands of hair of the braid when the pick member is pulled through the braid. The reservoir member is removably coupled to the pick member. The reservoir member is configured to permit gripping of the reservoir member to facilitate maneuvering of the pick member by the hand of the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

One significant advantage of the present invention is the angle portion extends at an angle to the main portion permits the user to hold the wrist at a more comfortable angle when applying the fluid to the hair, and also when inserting the angled portion between the strands and drawing the pick member along the length of the braid.

Another significant advantage of the present invention is the presence of the finger member in some embodiments that can be selectively positioned along the length of the reservoir member to allow the user to adjust the positioning of the finger member to accommodate the size of the users hand and provide additional control of the reservoir member and the pick member during use.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
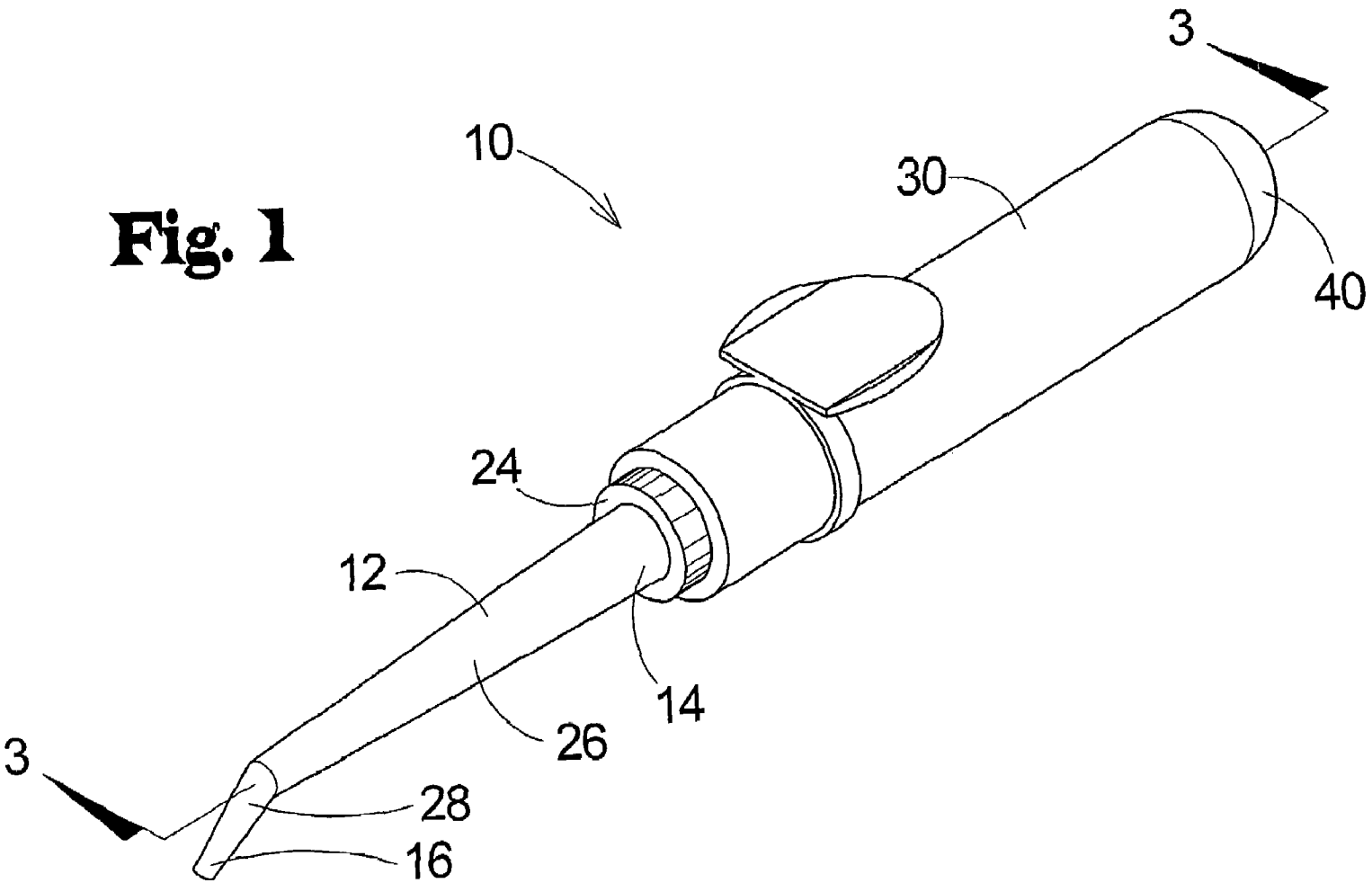
FIG. 1 is a perspective view of a new braid separation system according to the present invention.
Figure 2:
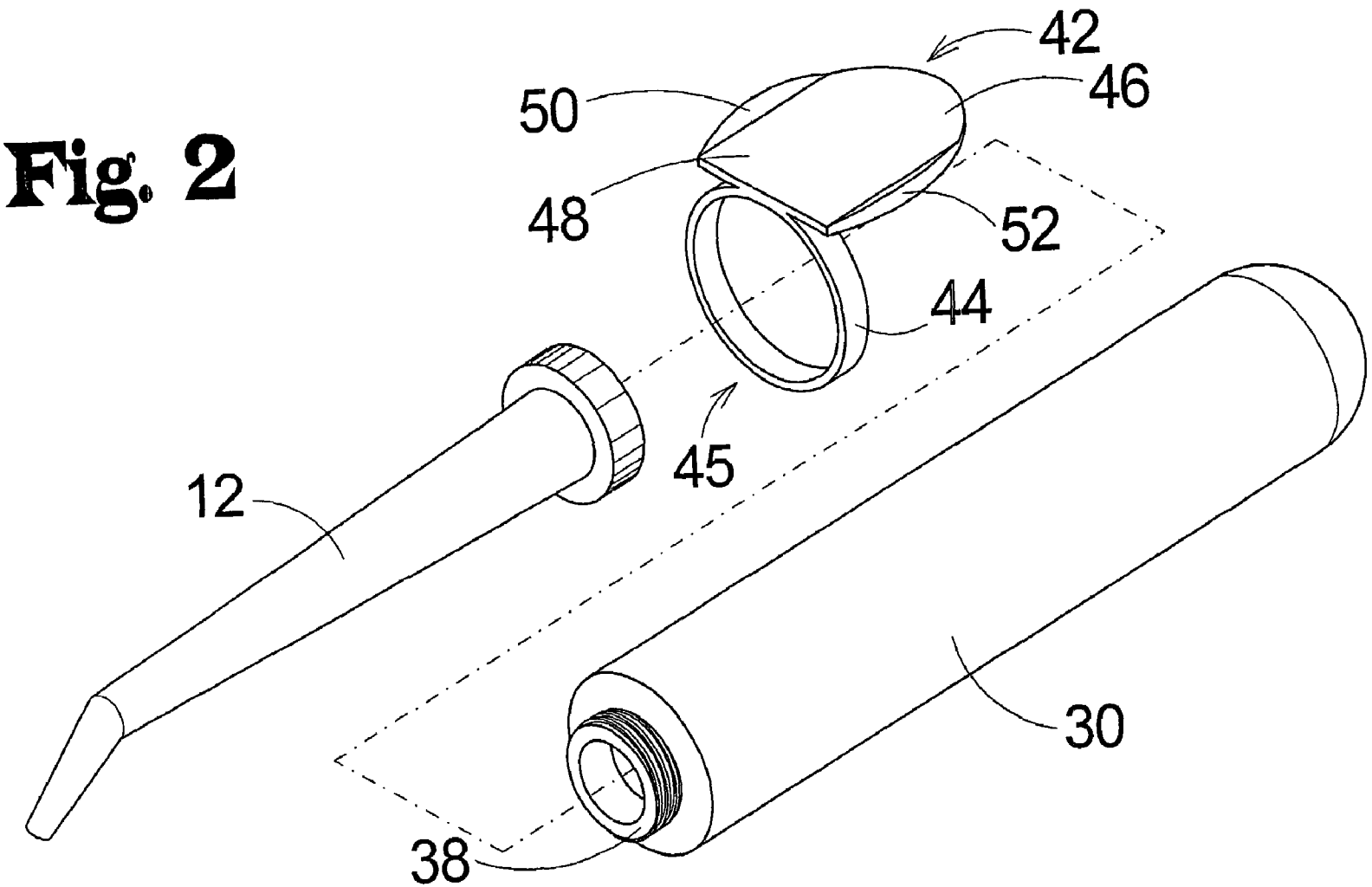
FIG. 2 is an exploded perspective view of the present invention.
Figure 3:
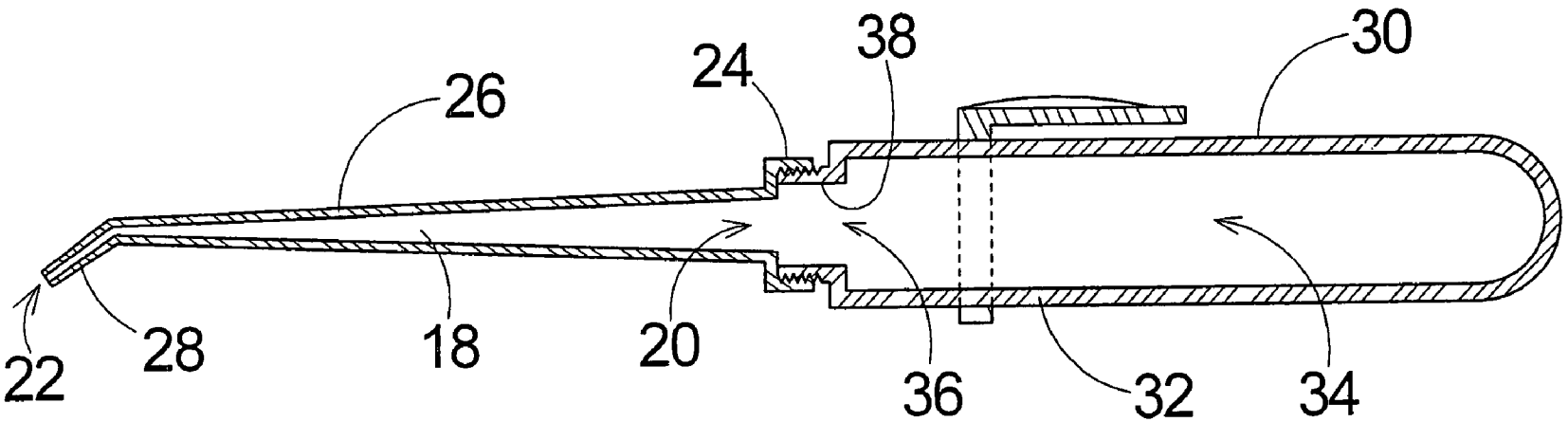
FIG. 3 is a cross-sectional view of the present invention taken along line 3-3 of FIG. 1.

With reference now to the drawings, and in particular to FIGS. 1 through 3 thereof, a new braid separation system, which may be known under the trademark BRAID-PIK, embodying the principles and concepts of the present invention and generally designated by the reference numeral 10 will be described.

As best illustrated in FIGS. 1 through 3, the braid separation system 10 generally comprises a pick member 12 for positioning between the strands of the braids and that is pulled through the braid to separate the strands of the braids. The pick member 12 has a length, which in some embodiments may be approximately 4 inches, which produces the most convenient handling of the system, but other lengths may also be employed.

The pick member has a proximal end 14 and a distal end 16, and a transverse width. The transverse width of the pick member may taper narrower in a substantially uniform manner from the proximal end to the distal end for facilitating insertion of the distal end of the pick member between the strands of hair of the braid. Significantly, this smooth and gradual tapering of the outer surface of the pick member from the tip end facilitates the insertion of the tip end in between the strands and further insertion of the pick member between the strands and gradually spreads the strands apart to help remove braided nature of the strands of hair. Thus, the strands of hair spread not only by pulling the pick member through the braided strands, but also progressively inserting the pick member between the strands. In the illustrative embodiment, the diameter of the proximal end has a diameter of approximately 5/16 of an inch, and the distal end has a diameter of approximately 1/16 of an inch.

The pick member 12 has a lumen 18 that extend along the length of the pick member from the proximal end to the distal end. The lumen 18 has a transverse width, and the transverse width may taper smaller or narrower from the proximal end to the distal end of the pick member. The lumen 18 originates at an intake opening 20, and terminates in a dispensing opening 22 at the distal end, or tip, of the pick member. The intake opening 20 is relatively larger in width than the dispensing opening 22.

The pick member 12 may further comprise a collar portion 24 positioned at the proximal end of the pick member. In the illustrative embodiment, the collar portion 24 has a width of about 7/32 of an inch and a diameter of about 5/8 of an inch, although other sizes may be employed.

The pick member 12 may also include a main portion 26 and an angled portion 28. The main portion 26 is positioned adjacent to the proximal end 14 of the pick member 12 and the angled portion 28 is positioned adjacent to the distal end 16 of the pick member. The angled portion 28 extends at an angle to the main portion 26 and a longitudinal axis of the pick member. The angle measures between 1 degree and 89 degrees, and preferably falls within the range of approximately 30 degrees and approximately 60 degrees. The angle of the angled portion 28 with respect to the main portion 26 facilitates insertion of the angled portion between the strands of the hair at an angle that is comfortable on the wrist of the user.

The system 10 also includes a reservoir member 30 for holding fluid to be applied to the hair by the pick member 12 to help relax the strands of hair of the braid when the pick member is pulled through the braid. The reservoir member 30 may be removably coupled to the pick member 12. The reservoir member is preferably elongated to form a handle to permit gripping of the reservoir member to facilitate maneuvering of the pick member 12 by the hand of the user. The reservoir member 30 may have a length of about 4 inches, which is convenient for holding by the hand of the user yet is not so large that maneuvering of the system 10 is impaired.

The reservoir member 30 comprises a perimeter wall 32 that defines an interior space 34 for receiving the fluid. The perimeter wall 32 defines an open end 36 that is in fluid communication with the interior space 34 for permitting insertion of the fluid into, and extraction of the fluid out of, the interior space 34 of the reservoir member 30. The open end 36 is in fluid communication with the lumen 18 of the pick member 12 to permit the fluid dispensed from the open end of the reservoir member to flow into the pick member for application to the hair. The perimeter wall 32 may comprise a resiliently flexible material for permitting the perimeter wall to be squeezed by hand pressure to constrict the interior space and force the liquid from the interior space and through the open end of the reservoir member. The flexible material of the perimeter wall is resilient to permit the perimeter wall to return to shape when the hand pressure is released from the reservoir member. The perimeter wall 32 may be substantially cylindrical, with a diameter of approximately 3/4 of an inch, to facilitate gripping by the user. The interior space of the reservoir member may have a diameter of about 11/16 of an inch and the open end may have a diameter of about 3/8 of an inch.

The perimeter wall 32 may form a neck 38 including a thread for threadedly engaging the collar portion 24 of the pick member to removably couple the pick member to the reservoir member 30. The neck 38 may have a diameter of approximately 1/2 of an inch and a width of approximately 1/4 of an inch, although other sizes may be employed.

The reservoir member 30 may have a base or free end 40 that has a substantially hemispherical shape to inhibit the free end from pressing uncomfortably against the palm of the hand when the reservoir member is gripped by the user.

A finger member 42 may be removably coupled to the reservoir member 30 to provide a rest for a finger of the user to provide further leverage and control of the pick member 12 when the pick member 12 is being inserted into and drawn through the braid. The finger member may have a length of approximately 1/1;4 inches and a width of approximately 1 inch.

The finger member 42 may comprise a ring portion 44 that is slidable over a portion of the reservoir member 30, such as the neck 38. The ring portion 44 defines an aperture 45 for receiving a portion of the reservoir member 30 when the free end of the reservoir member is inserted into the aperture. The ring portion 44 may have a diameter of approximately 1 inch and a width of approximately 1/4 of an inch.

The finger member 42 may further comprise a plate portion 46 that is coupled to the ring portion 44 for receiving the finger of the user to provide more precise control of the reservoir member 30 and the pick member 12 when the ring portion is mounted on the reservoir member. The plate portion 46 has a substantially planar surface 48 for resting the finger of the user on. The plate portion 46 may have a pair of angled surfaces 50, 52 that extend upwardly from and positioned on opposite sides of the planar surface 48 for cradling the finger of the user and to inhibit the finger of the user from slipping off of the planar surface. The substantially planar surface 48 may be oriented substantially perpendicular to a plane in which the ring portion 44 extends. The plate portion 46 may extend over a portion of the reservoir member 30. In the illustrative embodiment, the plate portion 46 may have a length of approximately 1 1/4 of an inch and a width of approximately 1 inch, although other sizes may be employed. Further, the plate portion 46 of the illustrative embodiment may have a thickness of approximately 1/16 of an inch measured to the top of the substantially planar surface, and a thickness of approximately 3/16 of an inch to the top of the angled surfaces. Other dimensions may also be employed.

In use, the fluid is poured into the interior space of the reservoir member 30 through the open end 36 of the reservoir member. The collar portion 24 of the pick member is then threaded onto the neck 38 of the reservoir member to couple the pick member 12 to the reservoir member 30 so that the lumen of the pick member is in fluid communication with the interior space of the reservoir member. The free end 40 of the reservoir member 30 is then inserted through the aperture 45 of the ring portion of the finger member and the plate portion slid to a desired position by the user. A finger of the user is then placed on the plate portion of the finger member to provide additional control of the reservoir member and pick member when the user grips the reservoir member. The user then places the distal end of the pick member along the hair of the braid and squeezes the reservoir member to force the fluid from the interior space of the reservoir member through the lumen of the pick member and onto the hair of the braid to help loosen the strands of hair in the braid. The user then inserts the distal end of the pick member between the strands of the braid and pulls the pick member towards the end of the braid to facilitate separating the strands of the braid from one another.

With respect to the above description then, it is to be realized that the optimum dimensional relationships for the parts of the invention, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

| Index of Elements for BRAID SEPARATION SYSTEM |
|---|
| 1. |
| 2. |
| 3. |
| 4. |
| 5. |
| 6. |
| 7. |
| 8. |
| 9. |
| 10. braid separation system |
| 11. |
| 12. pick member |
| 13. |
| 14. proximal end of pick member |
| 15. |
| 16. distal end of pick member |
| 17. |
| 18. lumen of pick member |
| 19. |
| 20. intake opening of pick member |
| 21. |
| 22. dispensing opening |
| 23. |
| 24. collar portion |
| 25. |
| 26. main portion |
| 27. |
| 28. angle portion |
| 29. |
| 30. reservoir member |
| 31. |
| 32. perimeter wall |
| 33. |
| 34. interior space of reservoir member |
| 35. |
| 36. open end of reservoir member |
| 37. |
| 38. neck of reservoir member |
| 39. |
| 40. free end of reservoir portion |
| 41. |
| 42. finger member |
| 43. |
| 44. ring portion of finger member |
| 45. aperture |
| 46. plate portion of finger member |
| 47. |
| 48. planar surface of plate portion |
| 49. |
| 50. (first) angled surface of plate portion |
| 51. |
| 52. (second) angled surface of plate port. |
| 53. |
| 54. |
| 55. |
| 56. |
| 57. |
| 58. |
| 59. |

-continued

| Index of Elements for BRAID SEPARATION SYSTEM |
|---|
| 60. |
| 61. |
| 62. |
| 63. |
| 64. |
| 65. |
| 66. |
| 67. |
| 68. |
| 69. |
| 70. |
| 71. |
| 72. |
| 73. |
| 74. |
| 75. |
| 76. |
| 77. |
| 78. |
| 79. |
| 80. |

We claim:

1. A braid separation system for facilitating unraveling braids formed with strands of hair of a person, the braid separation system comprises:

a pick member for positioning between the strands of the braids and being pulled through the braid to separate the strands of the braids, said pick member having a length;

said pick member having a proximal end and a distal end, said pick member having a transverse width, the transverse width tapering from said proximal end to said distal end for facilitating insertion of the distal end of said pick member between the strands of the braid;

said pick member having a lumen extending along the length of the pick member from said proximal end to said distal end of said pick member, said lumen having a transverse width, said transverse width tapering smaller from the proximal end to the distal end of said pick member, the said lumen terminating in a dispensing opening at the distal end of said pick member, said lumen originating at an intake opening, said intake opening being larger in width than said dispensing opening;

said pick member comprises a collar portion positioned at said proximal end of said pick member;

the pick member including a main portion and an angled portion, said main portion being positioned adjacent to the proximal end of said pick member and said angled portion being positioned adjacent to said distal end of said pick member, said angled portion extending at an angle to said main portion of said pick member, said angle measuring between approximately 1 degree and 89 degrees;

a reservoir member for holding fluid to be applied to the hair by the pick member to help relax the strands of hair of the braid when said pick member is pulled through the braid, said reservoir member being removably coupled to said pick member, said reservoir member being elongated to permit gripping of the reservoir member to facilitate maneuvering of said pick member by a hand of the user, said reservoir member comprising:

a perimeter wall defining an interior space for receiving the fluid, said perimeter wall defining an open end being in fluid communication with said interior space for permitting insertion of the fluid into and extraction of the fluid out of said interior space of said reservoir member, said open end being in fluid communication with said lumen of said pick member to permit the fluid dispensed from said open end of said reservoir member to flow into said pick member for application to the hair, said perimeter wall comprises a resiliently flexible material for permitting said perimeter wall to be squeezed by hand pressure to constrict the interior space and force the liquid from said interior space and through said open end of said reservoir member, said flexible material of said perimeter wall being resilient to permit said perimeter wall to return to shape when the hand pressure is released from said reservoir member, said perimeter wall is substantially cylindrical to facilitate gripping by the user;

said perimeter wall forming a neck including a thread for threadably engaging said collar portion of said pick member to removably couple said pick member to said reservoir member;

said reservoir member having a free end that has a substantially hemispherical shape to inhibit said free end from being uncomfortable when said reservoir member is gripped by the user;

a finger member being removably coupled to said reservoir member to provide a rest for a finger of the user to provide further control of said pick member when the pick member is being inserted into and drawn through the braid, said finger member comprising:

a ring portion being slidable over a portion of said reservoir member, said ring portion defining an aperture for receiving a portion of said reservoir member; and a plate portion coupled to said ring portion for receiving the finger of the user to provide more precise control of the reservoir member and the pick member when said ring portion is receives said reservoir member, said plate portion having a substantially planar surface for resting the finger on, said plate portion having a pair of angled surfaces extending upwardly from and positioned on opposite sides of said planar surface for cradling the finger of the user and to inhibit the finger of the user from slipping off of said planar surface, said substantially planar surface being oriented substantially perpendicular to a plane in which said ring portion extends.

* * * * *